US006899159B2

(12) United States Patent
Fischer et al.

(10) Patent No.: US 6,899,159 B2
(45) **Date of Patent: *May 31, 2005**

(54) METHOD AND APPARATUS FOR UPHILL CASTING WITH A MOULD WITH UNDERLYING POURING-IN OPENING WITH A SLIDE VALVE CLOSURE

(75) Inventors: Alexander Fischer, Swisstal (DE); Wolfgang Müller, Bamberg (DE)

(73) Assignee: Hydro Aluminium Deutschland GmbH, Bonn (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/332,588

(22) PCT Filed: Jul. 10, 2001

(86) PCT No.: PCT/EP01/07916

§ 371 (c)(1),
(2), (4) Date: Jun. 6, 2003

(87) PCT Pub. No.: WO02/04144

PCT Pub. Date: Jan. 17, 2002

(65) Prior Publication Data

US 2004/0011496 A1 Jan. 22, 2004

(30) Foreign Application Priority Data

Jul. 12, 2000 (DE) ..... 100 33 903

(51) Int. Cl.[7] ..... B22D 18/04
(52) U.S. Cl. ..... 164/119; 164/306
(58) Field of Search ..... 164/119, 306–311

(56) References Cited

U.S. PATENT DOCUMENTS

| | | | | |
|---|---|---|---|---|
| 3,529,753 A | * | 9/1970 | Mack | 222/595 |
| 3,627,018 A | | 12/1971 | Costello | |
| 3,905,419 A | | 9/1975 | Tenner | |
| 3,980,125 A | | 9/1976 | Portalier | |
| 4,257,543 A | | 3/1981 | Muschner et al. | |
| 5,524,700 A | * | 6/1996 | Gosch | 164/136 |

FOREIGN PATENT DOCUMENTS

| | | | |
|---|---|---|---|
| GB | 1028736 | | 5/1966 |
| HU | 206844 B | | 1/1993 |
| JP | 1-241352 | * | 1/1989 |
| WO | WO 02/04148 | * | 1/2002 |

* cited by examiner

*Primary Examiner*—Kuang Y. Lin
(74) *Attorney, Agent, or Firm*—Proskauer Rose LLP

(57) ABSTRACT

A method for uphill/low pressure casting of a liquid melt in a device which has a casting furnace lying below a casting table, a mould with an underlying pouring-in opening and a slide valve closure forming a flow-through channel having a substantially straight longitudinal course during casting the liquid melt. The casting method constitutes casting the liquid melt in the pouring-in opening of the mould, shutting off the slide valve closure by displacing an overlying opening section and an underlying opening section of the flow-through channel directly after casting the liquid melt in the mould, which liquid melt is still in the pouring-in opening. The liquid melt is lowered below the mouth opening of the riser pipe and the mould is placed on the riser pipe so that a downward pressure is set between the slide valve closure and the mouth opening of the riser pipe which behaves elastically flexibly.

18 Claims, 4 Drawing Sheets

METHOD AND APPARATUS FOR UPHILL CASTING WITH A MOULD WITH UNDERLYING POURING-IN OPENING WITH A SLIDE VALVE CLOSURE

BACKGROUND OF THE INVENTION

The invention relates to a method and an apparatus for uphill casting/low-pressure casting, especially of light metal alloys, with an underlying casting furnace having a riser pipe and a mouth opening of the riser pipe and having a mould with an underlying pouring-in opening and having a slide valve closure for the pouring-in opening, forming a flow-through channel which for casting takes on a substantially straight, longitudinal course of especially uniform cross-section.

Compared with gravity casting, uphill casting has the substantial advantage of a smooth controlled casting process. By this means the entrance of air bubbles and oxidation skin which is associated with any turbulence of the melt during casting is avoided. When using core packages as moulds, the separation and entrainment of moulding material in the gate and in the runner can be avoided which otherwise leads to a deterioration in the quality of the castings.

A disadvantage with uphill casting is that in general it is necessary to wait for the solidification process of up to 15 minutes duration before the mould just filled can be removed and the next mould can be brought over the casting furnace. In order to rectify this disadvantage, it has already been proposed that moulds should be closed directly after the low-pressure casting in the pouring-in opening and removed immediately from the riser pipe.

It is known from CH 415 972 that moulds for low-pressure casting can be provided with an underlying shut-off valve and a feeder head positioned thereover, below the mould cavity. The shut-off valve consists of a slider plate lying inside a pouring-in channel with a flow-through opening which is displaced transversely with respect to the pouring-in channel. The feeder head has a volume-displacing slider piston. Although the feeder head is heatable, after closure of the shut-off valve, there may be some solidification of the melt in the flow-through opening of the slider plate, which requires separate removal of the plug there formed before the next casting process.

DE-AS 2 147 678 discloses an apparatus for uphill casting in which a slider unit is secured to a mould. Here, a slider plate is inserted in the longitudinal course of the flow-through channel so that it sits flush for closure of the flow-through channel. The seal is incomplete.

DE 2 836 434 C2 discloses a three-plate slide valve closure for steel casting vessels which is designed to control the underlying outpouring of such vessels. Here are arranged in a cassette to be attached under the bottom of such vessels, from top to bottom, a base plate, a slide plate and a lower plate which have flow-through openings forming a flow-through channel. In this case, the opening in the lower plate in the direction of motion of the slide plate is approximately twice as large as the openings in the base plate and in the slide plate. The flow-through direction of the melt is continuously falling in this slide-valve closure.

SUMMARY OF THE INVENTION

The object of the following invention is to further improve a method and an apparatus of the specified type in order to accelerate the process sequence.

The solution lies in a method for uphill casting/low-pressure casting in which for shut-off in the slide valve closure, two opening sections of the flow-through channel directly adjacent one to the other are displaced with respect to one another transversely to the longitudinal course of the flow-through channel directly after casting with still liquid melt in the pouring-in opening, so that an overlying opening section remains in open communication with the pouring-in opening free from undercut and an underlying opening section remains in open communication with the mouth opening of the riser pipe, wherein the opening sections are completely offset with respect to each other, and in which in the riser pipe the melt is then lowered as far as below the mouth opening of the riser pipe, wherein the lower opening section of the flow-through channel is emptied of melt. A corresponding apparatus according to the invention is characterised in that the slide valve closure comprises mutually displaceable plates, each having a flow-through opening wherein the plates can be brought into overlap with their flow-through openings for casting and the plates are displaceable towards each other for shut-off so that the flow-through opening in the upper plate is in open communication with the pouring-in opening free from undercut and the flow-through opening in the lower plate is in open communication with the riser pipe, while the flow-through openings are completely offset with respect to each other. By this means the melt contained in a through opening in the flow-through opening of the upper plate remains in communication with the casting or the pouring-in opening of the mould such that it can easily be demoulded upwards after solidification and the melt contained in a through opening in the flow-through opening of the lower plate can flow back into the riser pipe. Immediately after shut-off the mould can be lifted from the casting table without even waiting for the solidification process in the gate and another mould with its slide valve closure can be placed on the riser pipe. In order to fully utilise the advantages of the method according to the invention, a plurality of moulds should thus be used. After said demoulding, the lifted mould is ready for use again without further measures to the slide valve closure by simply opening said closure.

The mutually displaceable plates can be moved relative to one another in a linear movement or in a rotating movement.

In an especially favourable design the method is implemented so that, after closure of the slide valve closure, the melt in the riser pipe is lowered to only slightly below the mouth opening of the riser pipe in order to reduce any intake of air to a minimum. It is especially favourable in this case if the riser pipe is acted upon by a protective gas during the slight lowering of the melt between the individual casting processes so that the oxidation at the melt level in the riser pipe is reduced.

A further favourable modification of the method consists in the fact that during placing of the mould on the riser pipe this behaves elastically flexibly with the part forming the mouth opening. Here it is especially provided that the mould is placed on the riser pipe so that a defined downward pressure is set between the slide valve closure and the part forming the mouth opening. This can be achieved, for example, during placing of the mould, by the mould being captured by the casting table after slight elastic deflection of the riser pipe. The mould can also be guided in guides transversely over the casting table so that in the casting position the riser pipe has taken up a slightly downward-pressed position. Finally, when the mould is clamped securely on the casting table, the casting furnace with the riser pipe can be driven upwards until the desired downward pressure is built up on the slide valve closure.

It is preferred here that the riser pipe passes through the casting table in an opening and the mouth opening of the riser pipe lies slightly above the plane of the casting table which merely serves to place the mould whereas the riser pipe and the slide valve closure come in contact directly with one another.

According to a first embodiment of the apparatus, it can be provided that the upper plate is displaceable and the lower plate is fixed, wherein the pouring-in opening of the mould is larger than the flow-through opening in the upper plate so that this overlaps the flow-through opening in the upper plate in both positions. According to an alternative embodiment of the apparatus, it is possible that the upper plate is fixed and the lower plate is displaceable and the mouth opening of the riser pipe is larger than the flow-through opening in the lower plate so that this overlaps the flow-through opening in the lower plate in both positions. In both cases two-plate slider valves are formed. Above the upper plate on the mould side there can also be a base plate also held in the frame of the slider valve closure whose flow-through opening must correspond to the pouring-in opening of the mould.

It is further possible that a part, hereinafter described as a contact plate of the riser pipe, which forms the mouth opening of the riser pipe and is securely located thereon, can be securely allocated instead of this to the slide valve closure so that a slide valve closure having a number of plates increased by one plate is formed. This further plate would be securely located on the frame of the slide valve closure, i.e. also with respect to the mould, where especially the combination of this further plate with a fixed upper plate and a moveable lower plate would be meaningful. An end flange of the riser pipe could then abut directly against this part.

Here it is especially to be proposed that a connection plate with the mouth opening of the riser pipe and the riser pipe securely connected thereby are fixed to one end of an elastic bellows and a base flange securely connected to the casting furnace is connected to the other end of the elastic bellows. If a mould is lowered onto the riser pipe, this bellows can equalize height and angular errors of the connecting plane of the mould.

In connection with a displaceable lower plate of the slide valve closure, it is proposed that the riser pipe has a connection flange at the upper end, on which a ceramic connection plate is held, directly forming the mouth opening of the riser pipe. Here it is especially provided that the mouth opening is a long opening and that the mouth opening expands downwards inside the connection plate with small aperture angles ($\alpha_3$, $\alpha_4$). The back flow of melt from the slide valve closure after shut-off is favoured by the flow-through opening in the lower plate expanding downwards with a small aperture angle ($\alpha_2$). In order to facilitate the demoulding of the solidified casting from the slide valve closure, it is provided that the flow-through opening in the upper plate expands upwards with a small aperture angle ($\alpha_1$).

The mould can be a permanent mould or especially a core package clamped in a mould frame. A slide valve closure can be securely arranged on this permanent mould or this mould frame while an actuating apparatus for the slide valve closure can be attached in a fixed position on the casting table on which the mould can be lowered. Naturally, every slide valve closure can also have a built-in actuating apparatus.

With reference to further details of the slide plates and the riser pipe, reference should be made to the claims to which reference is hereby made.

Insofar as uphill casting/low-pressure casting according to the invention is discussed previously, this initially relates to methods and apparatus wherein a controllable gas pressure is applied to the melt level in the sealed casting furnace which makes the melt in the riser pipe rise or fall. However also included are other methods and apparatus which controllably can convey the melt in the riser pipe, e.g. magnetic pumping arrangements at the lower end of the riser pipe in the casting furnace.

The uphill casting/low-pressure casting is hereinbefore related to a perpendicular gate of the moulds wherefrom are derived the corresponding designations upper plate/upper flow-through opening, lower plate/lower flow-through opening. The subject matter of the invention is not departed from, however, if moulds having horizontal gates are used, wherein the term "upper" is logically to be replaced by "mould-side" and the term "lower" is logically to be replaced by "riser pipe side" with a horizontally aligned flow-through direction but otherwise unchanged geometry and kinematics.

BRIEF DESCRIPTION OF THE DRAWINGS

Details of a preferred embodiment of the apparatus according to the invention are explained in the following with reference to the drawings wherein.

Figure 3A:
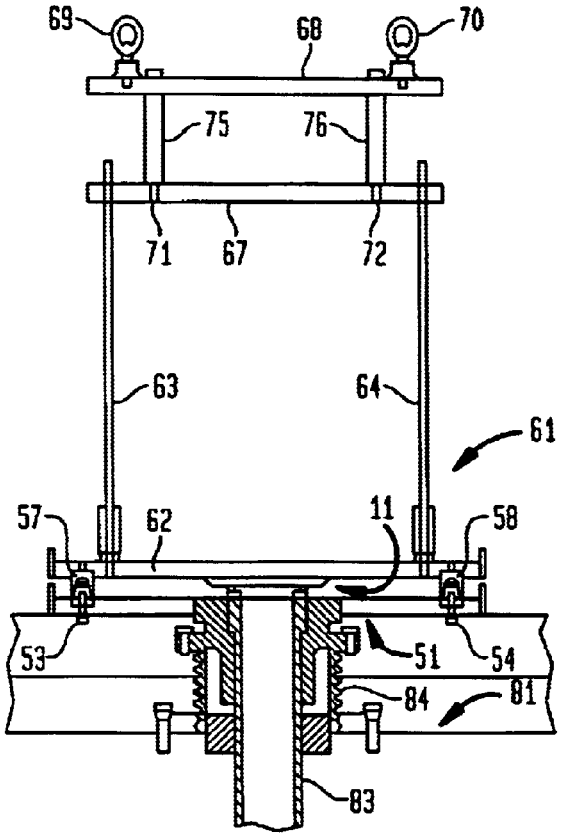
Figure 3B:
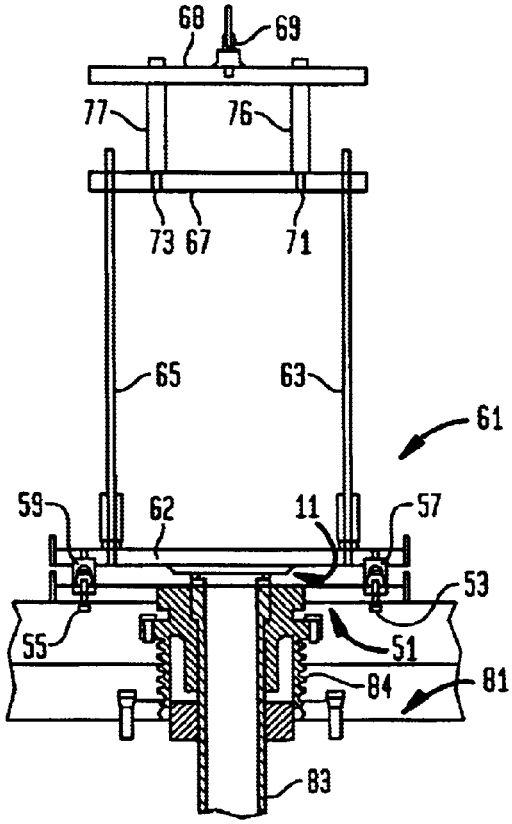
Figure 3C:
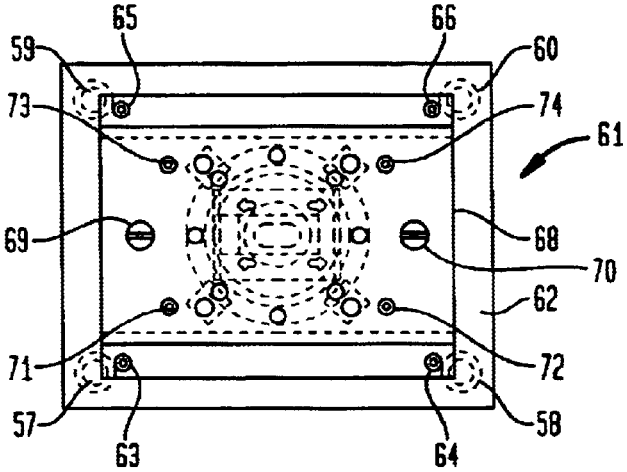

FIG. 3 shows a simplified view of a riser pipe with a casting table on which a mould frame with slider unit is positioned, a) in a first vertical section b) in a second vertical section c) in a top view of the mould frame.

DETAILED DESCRIPTION OF THE INVENTION

Figure 1B:
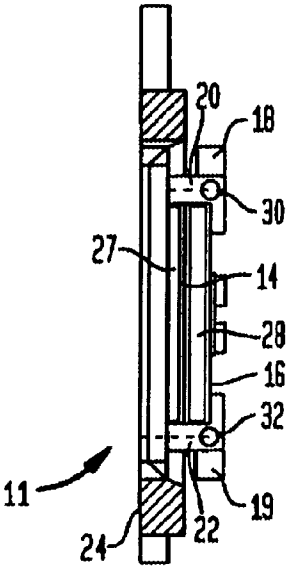
FIG. 1 shows a slider unit for attachment to a mould a) viewed from the bottom b) in longitudinal cross-section c) in transverse cross-section.
Figure 1A:
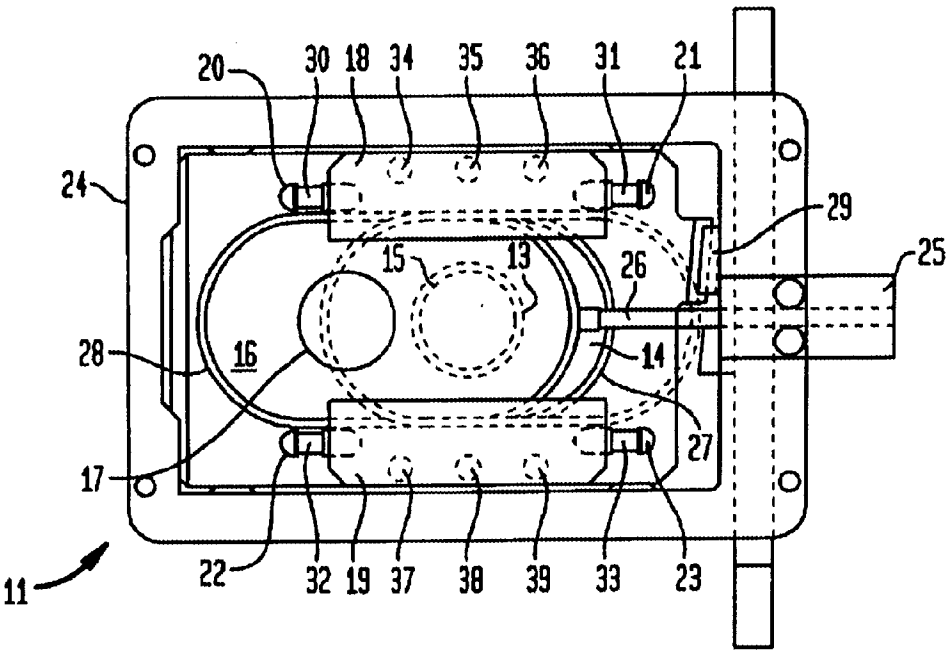
Figure 1C:
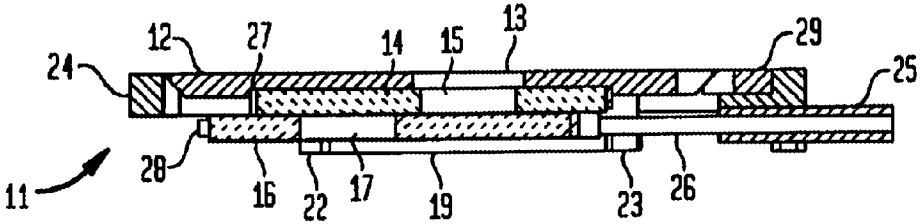

FIG. 1 shows a slide valve closure 11, comprising a base frame 24 which can be screwed from below onto a permanent mould/a mould frame for a core package. The base frame 24 holds a base plate 12 in sealing contact with a clamping face of the permanent mould/mould frame (not shown here) via a wedge element 29. The base plate 12 has a flow-through opening 13 which can be brought so that it overlaps with a pouring-in opening of the mould frame. On the base plate 12 there is a first fixed slide plate 14 with an upper flow-through opening 15; the first slide plate 14 is partly let into the base plate 12 and held in a frame 27. The frame 27 is used for low-stress fixing of the first slide plate 14 consisting of refractory material. The flow-through opening 15 of the securely arranged first slide plate 14 overlaps with the flow-through opening 13 in the base plate 12. The openings 13, 15 are undercut-free in the direction of the mould which is assumed to be above. Below the first slide plate 14 is a second slide plate 16 which has a lower flow-through opening 17. The slide plate 16 is in flat-sealing contact with the first slide plate 14 and clamped in a frame 28. The frame 28 is used for low-stress clamping of the second slide plate 16 consisting of refractory material. The two slide plates 14, 16 are pressed together and jointly towards the base plate 12 by spring holding means. The holding means are mounted directly on the base plate 12 and comprise two holding rails 18, 19 which are held in pairs of clips 20, 21, 22, 23 secured to the base plate 12 pivotably in pivots 30, 31, 32, 33. The second slide plate 16 is manipulatable by a rod 26 which acts on the frame 28 and slides in a guide piece 25 positioned on the base frame 24. Said holding rails 18, 19 are each supported via three compression springs 34, 35, 36, 37, 38, 39 on the base plate 12 and press directly on the second slide plate 16, acting as two-armed levers. Said flow-through openings 13, 15, 17 in the base plate 12 and in the slide plates 14, 16 are each circular. In the position depicted in FIG. 1*a* with a continuous line, the lower slide plate 16 is displaced with respect to the upper slide plate 15 such that the flow-through openings 15, 17 are completely offset relative to one another i.e., the slide valve closure is in its closed position. By means of the undercut-free shaping of the flow-through openings 13, 15, as mentioned above, a solidified plug piece on a casting can easily be demoulded upwards from these flow-through openings. In the position of the lower slide plate 16 shown by the dot-dash line in FIG. 1*a*, the lower flow-through opening 17 overlaps with the upper flow-through opening 15 and the flow-through opening 13 in the base plate i.e., the slide valve closure is in its opening position in which uphill casting is possible.

Figure 2A:
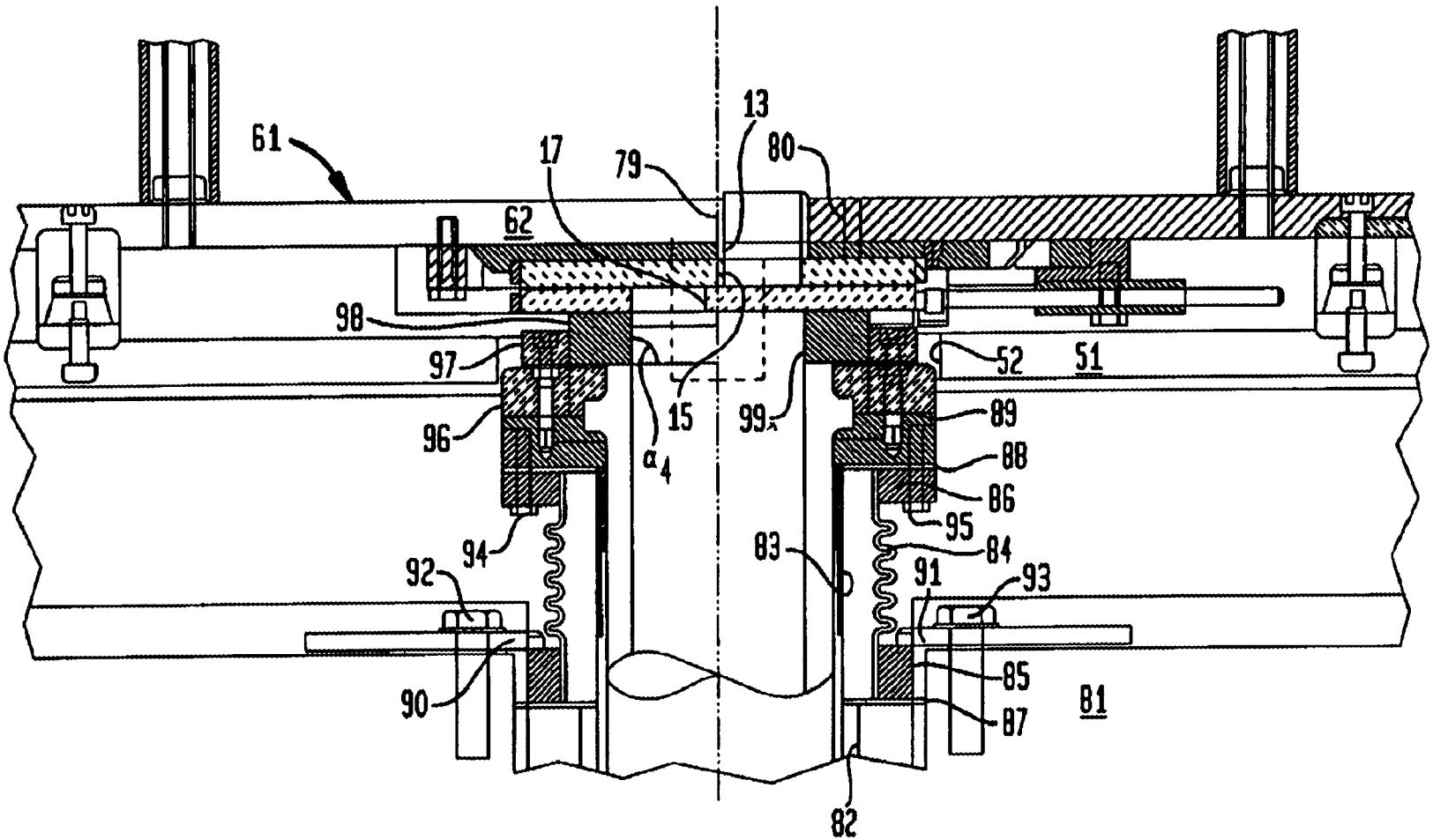
FIG. 2 shows a slider unit similar to FIG. 1 in an arrangement on a mould frame which is placed on a casting table from which a riser pipe emerges a) in a longitudinal cross-section in accordance with FIG. 1*b* b) in a transverse cross-section in accordance with FIG. 1*c;*
Figure 2B:
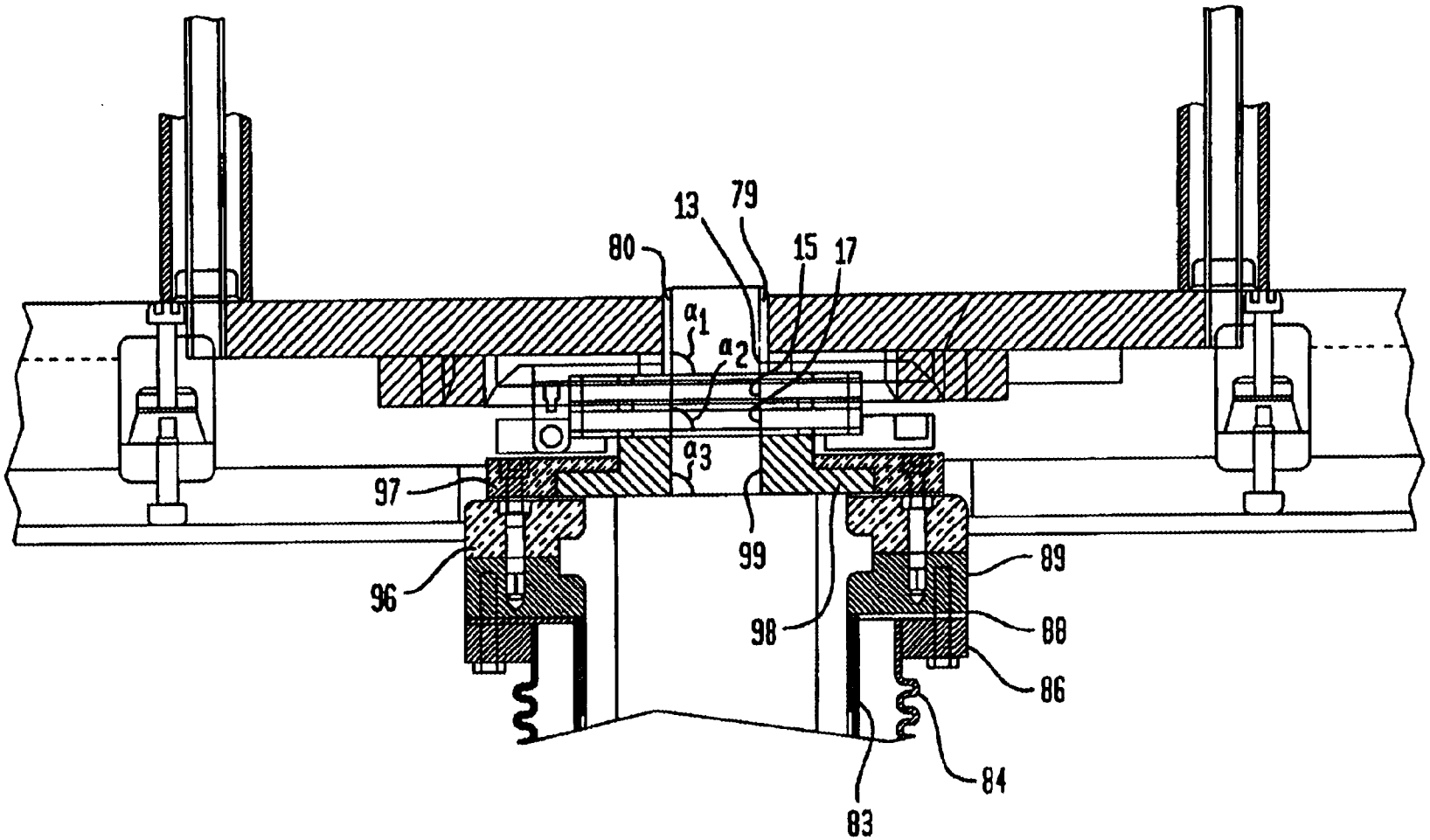

FIG. 2 shows the upper end of a casting furnace 81 (only FIG. 2*a*) as well as a casting table 51 positioned thereover and a mould frame 61 placed on the casting table in their mutual allocation for a casting process. The casting furnace 81 has an upper opening 82 in which a riser pipe 83 is inserted with an elastic bellows 84 positioned in between. For connection at the casting furnace 81 and the riser pipe 83 the bellows 84 has two connecting flanges 85, 86 which are sealed with respect to the casting furnace 81 and a riser pipe flange 89 positioned at the top of the riser pipe by means of seals 87, 88. The lower connecting flange 85 is clamped to the casting furnace 81 by means of holding clamps 90, 91 via screws 92, 93. The upper connecting flange 86 is screwed directly to the riser pipe flange 89 by means of screws 94, 95. Other screw connections are not numbered in detail. On the riser pipe flange 89 is placed a holding ring 96 which for its part supports a clamping ring 97. The clamping ring holds a contact plate 98 with a mouth opening 99. As can be seen clearly from a comparison of FIGS. 2*a* and 2*b*, the mouth opening 99 is oblong and is approximately twice as long as it is wide. The said parts forming the upper end of the riser pipe pass through the casting table 51 in a circular opening 52. Inserted in the casting table 51 are gripping pins 53, 54 on which gripping jaws 57, 58 of the mould frame 61 grip. The mould frame 61 has a base plate 62 with a pouring-in opening 79 in which a sleeve 80 made of refractory material is inserted. A slide valve closure 11 as in FIG. 1 is screwed onto the base plate 62 at the bottom wherein the sleeve 80 at the same time is fitted into the flow-through opening 13 in the base plate 12. The conical flow-through opening 15 of the upper slide plate 14 having a cone angle $\alpha_1$ which, as already mentioned, opens upwards, then fits onto the pouring-in opening 79. Onto the flow-through opening 15 in the downward direction then fits the flow-through opening 17 of the lower slide plate 16 having an aperture angle $\alpha_2$ which opens downwards, and then the mouth opening 99 in the contact plate 98 which has corresponding internal angles of skew $\alpha_3$, $\alpha_4$.

Between the riser pipe 83 and the opening 82 in the casting furnace 81 can be seen a ring slot which, as a result of the elasticity of the bellows 84, can compensate the contact plate 98 with respect to the slide valve closure 11 in the event of relative height and angular errors. When the contact plate 98 docks onto the slide valve closure 11, the bellows 84 is in any case slightly compressed so that a positive bearing pressure exists between the contact plate 98 and the slide valve closure 11 during casting.

Whereas in FIG. 2*a* the two flow-through openings 15, 17 are offset relative to one another and the slide valve closure 11 is thus in its closed position, in FIG. 2*b* the flow-through opening 15, 17 are aligned with one another so that the opening position is visible here. The details of the slide valve closure 11 are only partly designated here and are in agreement with FIG. 1.

The mould frame 61 as a complete entity can be seen in FIG. 3; however, the casting furnace 81 and the upper end of the riser pipe 83 are shown simplified compared with FIG. 2. Especially the bellows 84 with the connecting flanges are only reproduced symbolically. The mould frame 61 consists of the base plate 62, a cover plate 67 and clamping rods 63, 64, 65, 66. Above the cover plate 67 there is a mounting plate 68 to which are screwed two eyes 69, 70 which are screwed onto the cover plate 63 by means of bolts 71, 72, 73, 74 and sleeves 75, 76, 77, 78. The lower screw joints of the clamping rods 64, 65, 66 are protected by bushings not described in detail. Here again gripping pins 53, 54, 55 can be seen on the casting table 51, onto which pins the gripping jaws 57, 58, 59, 60 of the mould frame 61 have gripped. The mould frame 61 comprises a base plate 62 to which the slide valve closure 11 according to FIG. 1 is screwed. When the mould frame 61 is lowered onto the contact plate 98 on the riser pipe 83, the bellows 84 can deflect elastically in order to ensure that the contact plate 98 abuts completely flat onto the lower slide plate 16 of the slide valve closure 11. The size ratio of the mouth opening 99 in the connecting plate 98 and the flow-through opening 17 in the lower slide plate 16 is such that both in the opening position and in the closing position of the slide valve closure the flow-through opening 17 of the slide plate 16 remains in open communication with the mouth opening 99 of the contact plate 98 of the riser pipe 83. By this means it is possible for melt to flow back from the flow-through opening 17 into the riser pipe after closure of the slide valve closure 11.

LIST OF REFERENCE SYMBOLS

11 Slide valve closure
12 Base plate
13 Flow-through opening
14 First (upper) slide plate
15 Upper flow-through opening
16 Second (lower) slide plate
17 Lower flow-through opening
18 Holding rail
19 Holding rail
20 Clip
21 Clip
22 Clip
23 Clip
24 Base frame
25 Guide piece
26 Rod
27 Frame
28 Frame
29 Wedge element
30 Pivot

31 Pivot
32 Pivot
33 Pivot
34 Compression spring
35 Compression spring
36 Compression spring
37 Compression spring
38 Compression spring
39 Compression spring
51 Casting table
52 Circular opening
53 Gripping pin
54 Gripping pin
55 Gripping pin
56
57 Gripping jaw
58 Gripping jaw
59 Gripping jaw
60 Gripping jaw
61 Mould frame
62 Base plate
63 Clamping rod
64 Clamping rod
65 Clamping rod
66 Clamping rod
67 Cover plate
68 Mounting plate
69 Eye
70 Eye
71 Screw
72 Screw
73 Screw
74 Screw
75 Sleeve
76 Sleeve
77 Sleeve
78
79 Pouring-in opening
80 Sleeve
81 Casting furnace
82 Opening
83 Riser pipe
84 Bellows
85 Connecting flange
86 Connecting flange
87 Seal
88 Seal
89 Riser pipe flange
90 Clamp
91 Clamp
92 Screw
93 Screw
94 Screw
95 Screw
96 Holding ring
97 Clamping ring
98 Contact plate
99 Mouth opening

What is claimed is:

1. A method for uphill/low-pressure casting a liquid melt in a device which comprises a casting furnace lying below a casting table, the casting furnace having a riser pipe with a mouth opening, a mould having an underlying pouring-in opening, and a slide valve closure forming a flow-through channel comprising a substantially straight, longitudinal course during casting of the liquid melt, the flow-through channel being formed from an overlying opening section and an underlying opening section which are directly adjacent to one another, said method comprising:

casting the liquid melt into said mould through the pouring-in opening of the mould;

shutting off the slide valve closure by displacing the overlying and underlying opening sections of the flow-through channel with respect to one another transversely to the longitudinal course of the flow-through channel directly after casting the liquid melt, which liquid melt is still in the pouring-in opening, so that the overlying opening section remains in open communication with the pouring-in opening of the mould free from undercut, and the underlying opening section remains in open communication with the mouth opening of the riser pipe, and the overlying and underlying opening sections are completely offset with respect to one another;

lowering the liquid melt in the riser pipe below the mouth opening of the riser pipe, wherein the underlying opening section of the flow-through channel is emptied of the liquid melt; wherein the mould is placed on the riser pipe so that a defined downward pressure is set between the slide valve closure and the mouth opening of the riser pipe, wherein when the mould is placed on the riser pipe, said mouth opening of the riser pipe is elastically flexible.

2. The method of claim 1, wherein the liquid melt comprises light metal alloys.

3. The method of claim 1, further comprising lowering the liquid melt in the riser pipe only slightly below the mouth opening of the riser pipe after displacement of the overlying and underlying opening sections of the flow-through channel towards one another.

4. The method of claim 1, further comprising introducing a protective gas at the mouth opening of the riser pipe during lowering of the liquid melt after the displacement of the overlying and underlying opening sections of the flow-through channel towards one another.

5. The method of claim 1, further comprising lifting the mould with the slide valve closure from the mouth opening of the riser pipe via eyes on a mould frame after the lowering of the liquid melt in the riser pipe, wherein the underlying opening section of the flow-through channel is emptied of the liquid melt.

6. An apparatus for uphill/low-pressure casting a liquid melt, said apparatus comprising:

a casting furnace lying below a casting table, the casting furnace having a riser pipe with a mouth opening;

a mould having an underlying pouring-in opening and a slide valve closure for the pouring-in opening, said valve closure constituting a flow-through channel comprising a substantially straight, longitudinal course during casting of the liquid melt, wherein the slide valve closure comprises two plates, an upper and a lower plates, said two plates being relatively displaceable to each other and each having a flow-through opening, wherein the plates overlap with their flow-through openings during the casting of the liquid melt and are displaceable towards displaced relative to each other for shut-off, so that the flow-through opening in the upper plate is in open communication with the pouring-in opening free from undercut, and the flow-through opening in the lower plate is in open communication with the mouth opening of the riser pipe while the flow-through openings are completely offset with respect to each other, and wherein the riser pipe is constructed elastically flexible so that after placing the mould, a defined downward pressure is set between the slide valve closure and the mouth opening of the riser pipe.

7. The apparatus of claim 6, wherein the liquid melt comprises light metal alloys.

8. The apparatus of claim 6, wherein the upper plate is displaceable in a linear and the lower plate is fixed, wherein the pouring-in opening of the mould is larger than the flow-through opening of the upper plate so that it overlaps with the flow-through opening of the upper plate in both its positions.

9. The apparatus of claim 6, wherein the upper plate is fixed and the lower plate is displaceable in a linear, wherein the mouth opening of the riser pipe is larger than the flow-through opening of the lower plate so that it overlaps the flow-through opening of the lower plate in both its positions.

10. The apparatus of claim 6, wherein the flow-through opening in the lower plate expands downwards with a small aperture angle.

11. The apparatus of claim 6, wherein the flow-through opening in the upper plate expands upwards with a small aperture angle.

12. The apparatus of claim 6, wherein the mould comprises a permanent mould or a core package clamped in a mould frame.

13. The apparatus of claim 6, wherein the upper end of the riser pipe is elastically connected to an outlet opening for the riser pipe in the casting furnace by means of a bellows coaxially surrounding said riser pipe.

14. The apparatus of claim 12, wherein the slide valve closure is securely connected to the permanent mould or to the mould frame.

15. The apparatus of claim 13, wherein the bellows comprises connecting flanges at both ends.

16. The apparatus of claim 13, wherein the riser pipe comprises a connecting flange at the upper end on which a ceramic contact plate is held, said ceramic contact plate directly forming the mouth opening of the riser pipe.

17. The apparatus of claim 16, wherein a feed opening for protective gas is located in or under the ceramic contact plate.

18. The apparatus of claim 16, wherein the mouth opening of the riser pipe is a long opening, said mouth opening expanding downwards inside the two connecting plates with small aperture angles.

* * * * *